United States Patent [19]

Klundt

[11] 4,075,960

[45] Feb. 28, 1978

[54] LUBRICATING OIL SEALING DEVICE FOR A SEWING MACHINE

[75] Inventor: Kurt Klundt, Hirschhorn, Germany

[73] Assignee: Pfaff Industriemaschinen GmbH, Germany

[21] Appl. No.: 809,777

[22] Filed: Jun. 24, 1977

[30] Foreign Application Priority Data

Jul. 2, 1976 Germany ..... 2629713

[51] Int. Cl.[2] ..... D05B 71/00

[52] U.S. Cl. ..... 112/256

[58] Field of Search ..... 112/256, 215, 216; 184/6.15

[56] References Cited

U.S. PATENT DOCUMENTS

| | | | |
|---|---|---|---|
| 1,555,187 | 9/1925 | Cook et al. | 112/215 |
| 1,899,816 | 2/1933 | Maier | 112/215 |
| 2,199,666 | 5/1940 | Kucera | 112/215 |

*Primary Examiner*—George H. Krizmanich
*Attorney, Agent, or Firm*—McGlew and Tuttle

[57] ABSTRACT

A sewing machine includes a housing located below a reciprocating needle which contains two feed supports which are driven by operating mechanism so that they move through a substantially rectangular course of motion in their own plane. The feed supports include elongated members which extend through an opening in a front wall of a base of the sewing machine, and this wall is substantially closed against the outward splashing of oil by a first gasket which is engaged over the two support members which operate alongside each other and it is mounted so that it moves vertically to accommodate the vertical movement of the members. A second seal is effected by U-shaped sealing elements which engage over respective feed supports from respective opposite sides inwardly so that when the two supports are in alignment, the sealing members form a complete encirculing web. The sealing elements are disposed so that they move in a space within a frame located in the wall opening and the operation is such that any oil which is picked up by the supports is deflected either directly downwardly off the support or into inlets defined in the two feed supports which lead to an oil duct defined therebetween and then to an oil discharge which extends downwardly to a location below the machine base, for example, into an oil pan.

6 Claims, 5 Drawing Figures

LUBRICATING OIL SEALING DEVICE FOR A SEWING MACHINE

FIELD AND BACKGROUND OF THE INVENTION

This invention relates in general to sewing machines and, in particular, to a new and useful sewing machine which includes a swingingly driven structural element passing through a case opening and through a gasket provided in its range.

In a known sewing machine (German Patent No. 945,426), two parallel cloth feed support pass through an unsealed case opening. A drop nose is arranged on the joint between the cloth feed supports and the driving guide rod, which has the effect that lubricating oil in the range of this joint is thrown into the interior of the case. This measure cannot prevent splashing oil from accumulating in the range of the case opening on the cloth feed supports and issuing from the case through the case opening. Under these circumstances, lubricating oil can get to the cloth feeders and soil and sewing material.

A sewing machine is also known from German DOS 2,213,938, wherein two parallel cloth feed supports, passing through a case opening, are arranged on the outside of the case in a guide from gasket which surrounds the two cloth feed supports circularly, and thus prevents lubricating oil from issuing from the case opening. In a high speed operation of the sewing machine, the oil issuing from the bearings of the moveable driven element is thrown off and arrives as splashing oil on the cloth feed supports and on the inside of the gasket. Under these circumstances, if the gasket is damaged or the sealing surfaces are worn out or soiled, a part of the lubricating oil penetrates to the outside and thus soils the sewing material.

SUMMARY OF THE INVENTION

The present invention is directed to a sewing machine in which the gasket is shielded to a great extent against splashing lubricating oil flowing along the structural element passing through the case opening. For this purpose, a second seal is arranged at a distance from the gasket, and an oil duct is provided in the movable structural element which has an inlet opening between the seals and an outlet opening on the side of the gasket opposite to the inlet opening.

The additional seal arranged at a distance from the gasket which can likewise be a gasket, captures the oil splashing in the direction of the case opening, so that the outer gasket is shielded against splashing oil. Lubricating oil penetrating between the structural element and the inner seal which is on the lateral surfaces of the structural element, flows down under the action of gravity; combines with the lubricating oil on the underside of the structural element, and forms drops which are returned into the interior of the case after falling off over an inclined surface of the case. However, the lubricating oil between the outer gasket and the inner seal on the top side of the element is returned into the interior of the case by means of the oil duct, according to the invention, since the lubricating oil enters the inlet opening and then flows into the oil duct and finally issues from the structural element through the outlet opening on the side of the inner seal facing the interior of the case, and drips off.

The arrangement of the additional seal and the design of the oil duct provides a combination of shut-off and returning means for the lubricating oil. This combination results in a highly effective lubricating oil seal between the interior of the case and the case opening, so that only a small portion of the lubricating oil can get to the inside of the outer gasket. In this way, only small amounts of lubricating oil can flow through the case opening, even if the outer gasket is damaged or prematurely worn out, so that the risk of soiling the sewing material is very small, even under the most unfavorable circumstances.

According to another feature of the invention, the additional inner seal is formed by webs and web plates in spaced arrangement. The webs are arranged on the structural element and enclose the element circularly, while the web plates are aligned substantially parallel to the webs and are secured on the case and embrace the structural element at a distance between the webs. These webs and web plates thus form a seal without touching each other, which is not subject to wear and thus need not be serviced.

Another feature of the invention consists in that, in a sewing machine with two parallel cloth feed supports, each having a fastening arm passing through a case opening, the part of the fastening arm inside the case is provided with a U-shaped cross-section and the fastening arms bear on each other to form the oil duct with the free end faces of the legs. Since swingingly moving parts in high speed sewing machines should have as small as possible a mass and low weight, the U-shaped design of the fastening arms results not only in the formation of the oil duct which serves to return the oil, but also has the advantage of reducing the weight of the cloth feed supports.

According to another feature of the invention, a carrier plate serving to receive the webs is secured on the fastening arms which covers at least the underside of each fastening arm and is wedge-shaped in the range transverse to the longitudinal direction of the fastening arms. The wedge-shaped form of the carrier plates has the effect that the lubricating oil on the underside of the carrier plates flows toward the lower boundary edge, forms the drops there, and is soon thrown off.

According to another feature of the invention, the webs are subdivided into a U-shaped section covering at least the top side of the two fastening arms and a straight section. Furthermore, at least one substantially downwardly pointing tip is provided on the underside of the sections and the sections are secured in alternate order on the two carrier plates. Due to the subdivision of the webs into two sections, the webs can be arranged easily on the fastening arms. With different amounts of feed of the two cloth feed supports, a mutual distance may occur between the two associated sections of a web, but the top side of the two fastening arms is covered by the upper leg of the U-shaped sections transverse to the longitudinal direction so that in this case also, the lubricating oil flowing in the direction of the case opening is stopped. The alternating arrangement of the U-shaped and straight sections on the carrier plates makes it possible to provide, for both fastening arms, two identical one-piece sealing elements, merely staggered by 180° C, which can be produced, for example, by injection molding in one operation.

Accordingly, it is an object of the invention to provide a sewing machine which has a housing with a wall opening therethrough and with first and second material feed supports which are adapted to move backwardly and forwardly and upwardly and downwardly through the opening in the housing and which further includes a first seal gasket disposed at the exit of the opening and mounted so that it moves upwardly and downwardly to accommodate the movement of the feed supports and a second seal means including first and second sealing members which engage over the respective opposite exterior sides of the first and second feed supports and define a second seal means with a frame member through which they operate and which also includes an oil inlet defined in the feed supports into which the oil may be deflected for passage through an oil duct and then through a discharge.

Another object of the invention is to provide a lubricating oil sealing device for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
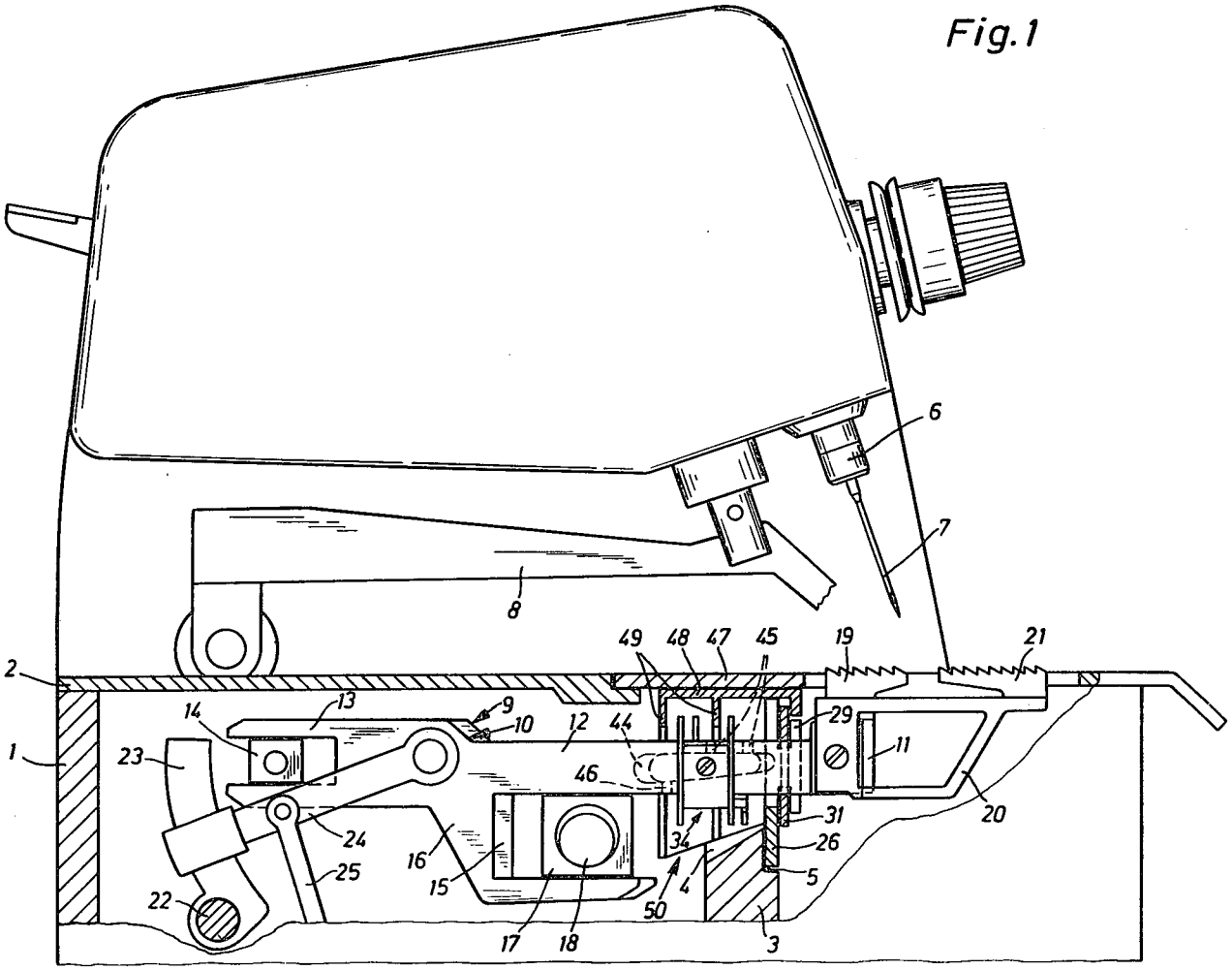
FIG. 1 is a side elevational view, partly in section, of a sewing machine constructed in accordance with the invention.

Referring to the drawings in particular, the invention embodied therein, comprises a sealing arrangement for a sewing machine which includes movable parts which move backwardly and forwardly and upwardly and downwardly through an opening in a front wall 3 of the sewing machine and which includes a first sealing arrangement 31 at the exit of the opening and a second sealing arrangement 50 within the housing provided to ensure against oil contamination of the sewing area of the machine.

The sewing machine represented in FIG. 1 is an overcast sewing machine whose case is designated 1. The lower part of case 1 has a work-support plate 2 and a front wall 3 which is provided with a passage 4 and a plane-surfaced recess 5.

A needle bar 6 which carries a needle 7 is mounted above work support plate 2. Furthermore, a cloth presser 8 is also shown which carries a presser foot (not shown). Two cloth feed supports 9 and 10 are arranged below work support plate 2 and bear on each other, and each have a respective fastening arm 11 and 12 protruding through passage 4. The cloth feed supports 9 and 10 include forked rear ends 13 mounted on a common rotatably mounted sliding block 14 and embrace with the fastening arms 11 and 12 and angular extensions 15 and 16 of the arms on a common sliding block 17. The block 17 cooperates with a lifting eccentric 18 which is rotated during the operation of the machine. A main cloth feed 19 is secured on the fastening arm 11 of the rear cloth feed support 9 as shown in FIG. 1. The fastening arm 12 of the front cloth feed support 10 is secured to a frame plate 20 which carries a differential cloth feed 21.

Cloth feed support 9 is swingingly driven in a known manner, and is therefore not shown in the drawing, by a swing lever (not shown) secured on a swing shaft 22 and by a pull rod (not shown) which swings in horizontal direction. A curved swing lever 23 is secured to the swing shaft 22 and a pull rod 24 is pivotally mounted with one end on the cloth feed support 10 and is displaceable with the other end on the swing lever 23. The radial distance between the displaceably mounted end of pull rod 24 and the swing shaft 22 is variable by means of an adjusting tie rod 24. Cloth feed support 10 is thus also driven to oscillate in horizontal directions by means of swing lever 23 and pull rod 24. The horizontal oscillations or swinging motions produced by the swing levers and the pull rods are superposed on the vertical swinging motions produced by lifting eccentric 18, so that the cloth feed supports 9 and 10 perform a rectangular movement in a vertical plane. In order to obtain a certain sewing result, the amount of feed of the differential cloth feed 21 can be reduced or increased relative to the amount of feed of the main cloth feed 19 by displacing pull rod 24. In this case, the two cloth feed supports 9 and 10 are constantly displaced relative to each other during the operation of the sewing machines.

Ahead of passage 4 and arranged in recess 21 is a carrier plate 26 which has an extension 28 on both sides of a rectangular cut 27 with a vertically extending guide bar 29. The lateral boundary surfaces of a cut-out portion 27 form, together with the surfaces of extensions 28 and of guide bars 29 extending in the same plane, guide faces 30, 30 for the cloth feed supports 9 and 10 bearing tightly on the fastening arms 11 and 12. By this construction, oil on the lateral faces of fastening arms 11 and 12 is prevented from issuing from case 1. A gasket 31, which has a central opening defining a passage 32, is displaceably mounted between the free plane surface of carrier plate 26 and the guide bars 29. The spacing between the horizontal boundary surfaces 33 of passage 32 corresponds to the height of the fastening arms 11 and 12 passing through this passage 32. Gasket 31 thus prevents oil on the top and underside of fastening arms 11 and 12 from issuing from case 1. The distance between the vertical boundary surfaces of passage 32, not represented in the drawing, can be selected at random. These vertical boundary surfaces need not bear on the fastening arms 11 and 12 since their lateral surfaces are already sealed by the carrier plate 26. As seen from FIG. 4, there is a relatively great vertical distance between the horizontal boundary surfaces 33 of the passage 32 and the extensions 28. This distance permits gasket 31 to follow freely the vertical movements of cloth feed supports 9 and 10, without striking extensions 28.

A sealing element 34 is secured on each fastening arm 11 and 12 and consists of an angular carrier plate 35, a U-shaped web section 36 and a straight web section 37 arranged at a horizontal distance from the section 41.

Figure 2:
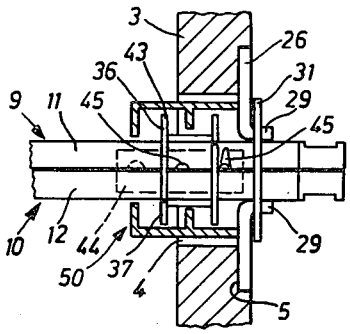
FIG. 2 is a top view, partly in section, of the cloth feed support and the sealing elements with the same amount of feed of the two cloth feeds, constructed in accordance with the invention.
Figure 3:
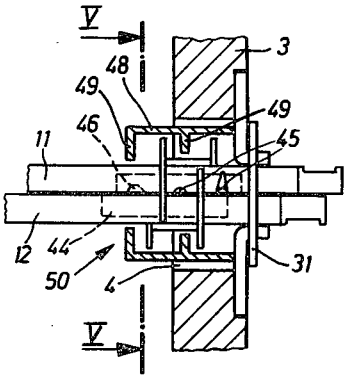
FIG. 3 is a view of the cloth feed supports and the sealing elements, similar to FIG. 2, but with different amounts of feeds of the two cloth feeds.
Figure 4:
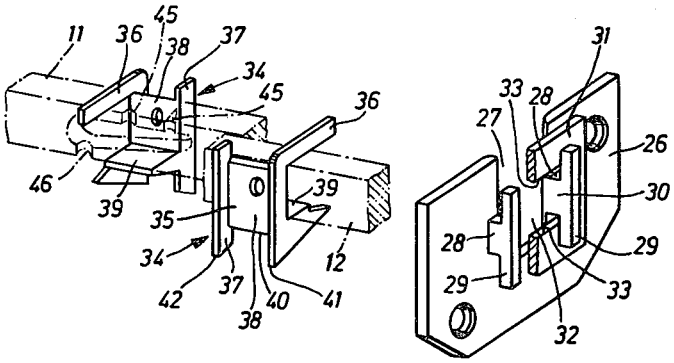
FIG. 4 is an exploded perspective view of the sealing elements.
Figure 5:
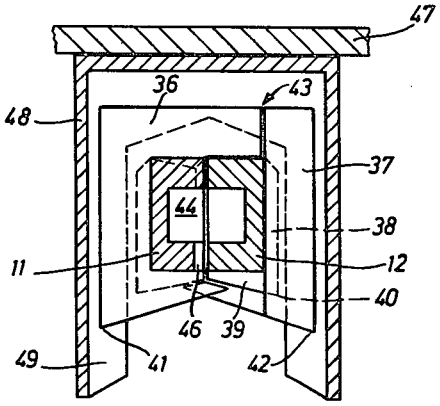
FIG. 5 is a section along the line V—V of FIG. 3 on an enlarged scale.

The angular carrier plate 35 bears with its vertical leg 38 on the lateral surface of the corresponding fastening arm 11 or 12 and with its horizontal leg 39 on the underside of the arms. As shown in FIGS. 4 and 5, the horizontal leg 39 is wedge-shaped transverse to the longitudinal direction of fastening arms 11 and 12. The resulting low boundary edge is designated 40. As it can furthermore be seen from FIGS. 4 and 5, the lower parts of the web sections 36 and 37 are also wedge-shaped so that the web sections 36 and 37 form at the bottom outer ends or tips 41 and 42. The sealing elements 34 are arranged at 180° relative to each other. As shown in FIG. 2, the sealing elements 34 are so aligned that they oppose each other with equal amount of feed of main cloth feed 19 and differential cloth feed 21, so that a web section 36 and a web section 37 extend in a common plane and form an annular web 43. With different amounts of feed of cloth feeds 19 and 21, the two sealing elements 34 are likewise displaced with cloth feed supports 9 and 10 and the associated web sections 36 and 37 can be so far apart, for example, at the end points of their horizontal swinging movements, as shown in FIGS. 1 and 3.

According to FIG. 5, the fastening arms 11 and 12 have a U-shaped cross-section. Since they bear on each other with the free end faces of their legs, they form an oil duct 44 which extends in the longitudinal direction of the cloth feed supports 9 and 10. Two cuts are provided in the upper part of a fastening arm 11, extending from its top side to the oil duct 44, which form two inlet openings 45 for oil duct 44. A cut extending from oil duct 44 to the underside of fastening arm 11 is provided in the lower part of fastening arm 11 and forms an outlet opening 46. The inlet openings 45 have a lesser spacing from gasket 31 than outlet opening 46.

A U-shaped frame 48 surrounding fastening arms 11 and 12 and sealing elements 34 is secured on the underside of a carrier plate 47 arranged depressed in work support plate 2. Frame 48 also carries two axially spaced U-shaped web plates 49. Web plates 49 are arranged between the webs 43 and are parallel to the webs. Web plates 49 embrace fastening arms 11 and 12 and the angular carrier plates 35 with a certain spacing so that they form, together with web sections 36 and 37, a second seal, generally designated 50, without touching each other.

Web plates 49, secured in the case, and the swinging web sections 36 and 37, collect the lubricating oil thrown off from the rotating or swinging structural elements of the sewing machine in the direction of passage 4, so that gasket 31 is shielded against splashing oil. The collected oil flows down on the vertical surfaces of web plates 49, web sections 36 and 37 and the angular carrier plates 35, and forms drops together with the oil on the underside of legs 39 at the boundary edges 40 and the tips 41 and 42, which fall or are finally thrown off to an inclined surface of case 1 in the range of passage 4, from where the oil returns into the interior of the case 1. The oil between the annular web 43, as well as between gasket 31 and the nearest sealing element 34 on the top side of fastening arms 11 and 12 flows under the action of gravity into the two inlet openings 45; arrives in oil duct 44, and finally leaves oil duct 44 through outlet opening 46, finally dripping off into the interior of case 1. The flow of the oil into inlet openings 45 can be enhanced by a funnel-shaped design of the upper end of these inlet openings 45.

The sealing elements 34 form, together with the web plates 49, a good shield against advancing lubricating oil, even if the cloth feeds 19 and 21 work with different amounts of feed and, consequently, the associated web sections 36 and 37 do not form closed annular webs 43. Since the upper leg of the U-shaped web section 36 covers the top side of both fastening arms 11 and 12, oil flowing on the top side of both fastening arms 11 and 12 is retained in this case also, and is shunted into the inlet openings 45.

Web sections 36 and 37 and web plates 49 which form the second seal, yield, together with oil duct 44, a combination of shut-off- and return means for the lubricating oil, so that only a small portion of the lubricating oil arrives at the inside of gasket 31. In this way, only small amounts of lubricating oil can issue through passage 4 of case 1, even if gasket 31 is damaged or prematurely worn-out, so that the risk of soiling the sewing material is very small even under these unfavorable circumstances.

While a specific embodiment of the invention has been shown and described in detail to illustrate the application of the principles of the invention, it will be understood that the invention may be embodied otherwise without departing from such principles.

What is claimed is:

1. A sewing machine, comprising a housing having a wall with an opening therethrough, first and second material feed supports adapted to move backwardly and forwardly and upwardly and downwardly through the opening in said wall, said supports being movable relatively to each other and defining an oil duct therebetween having an oil inlet and an opposite oil outlet, first seal means engaged over the feed supports, means for mounting said first seal means adjacent the opening on the exterior of the wall so as to permit movement of said support means and to prevent the outward passage of the oil through the opening, and second seal means including first and second sealing members engageable over respective opposite exterior sides of said first and second feed supports on the interior of said housing adjacent the opening in said wall, and a frame in said opening having portions cooperable with said first and second sealing members to deflect oil from said members into the inlet.

2. A sewing machine, according to claim 1, wherein said frame defines web plates disposed around said first and second sealing members in said housing adjacent the opening, said first and second sealing members defining an extension extending around a side, top and bottom of an associated feed support.

3. A sewing machine, according to claim 1, wherein said feed supports comprise two parallel cloth feed members arranged side-by-side and being of substantially U-shaped cross-section so as to define a cavity within the cross-section which faces inwardly toward the cavity of the adjacent feed support to form an oil duct therebetween.

4. A sewing machine, according to claim 3, wherein said first and second sealing members comprise carrier plates engaged over each of said feed supports and has at least a portion covering the underside of the associated feed support which is of wedge-shaped configuration and extends transversely to the axis of said feed support.

5. A sewing machine, according to claim 4, wherein said carrier plates include a side plate portion secured to the side of the associated feed support with a substantially vertical plate adjacent one edge of said side plate portion extending perpendicularly outwardly from said feed support and defining upper and lower portions which extend above the associated feed support and also including a U-shaped plate member which extends around a bottom side and top of the associated feed support and is long enough to extend beyond it to cover the adjacent feed support, a portion of said U-shaped plate covering said second feed support acting to deflect oil from the surface of the supports into the inlets thereof.

6. A sewing machine, according to claim 5, wherein said carrier plate on each support moves with the supports so that they are moved into and out of alignment and which, when they are in alignment, forms an enclosing web extending completely around said supports.

* * * * *